US006989804B2

(12) United States Patent
Correa et al.

(10) Patent No.: US 6,989,804 B2
(45) Date of Patent: Jan. 24, 2006

(54) METHOD AND APPARATUS FOR PROCESSING VIDEO PICTURES, ESPECIALLY FOR IMPROVING GREY SCALE FIDELITY PORTRAYAL

(75) Inventors: Carlos Correa, Schwenningen (DE); Cédric Thebault, Villingen (DE); Sébastien Weitbruch, Mönchweiler (DE); Rainer Zwing, Villingen (DE)

(73) Assignee: Thomson Licensing S.A., Boulogne-Billancourt (FR)

( * ) Notice: Subject to any disclaimer, the term of this patent is extended or adjusted under 35 U.S.C. 154(b) by 230 days.

(21) Appl. No.: 10/385,599

(22) Filed: Mar. 11, 2003

(65) Prior Publication Data

US 2003/0201952 A1 Oct. 30, 2003

(30) Foreign Application Priority Data

Apr. 11, 2002 (EP) ..... 02290907

(51) Int. Cl.
*G09G 5/10* (2006.01)

(52) U.S. Cl. ..... 345/63; 345/77

(58) Field of Classification Search ..... 345/60, 345/63, 77, 89, 147–149
See application file for complete search history.

(56) References Cited

U.S. PATENT DOCUMENTS 6,144,364 A * 11/2000 Otobe et al. ..... 345/691
6,417,835 B1 * 7/2002 Otobe et al. ..... 345/690
6,563,486 B2 * 5/2003 Otobe et al. ..... 345/589
2001/0033263 A1 * 10/2001 Yamada et al. ..... 345/89
2002/0130826 A1 * 9/2002 Otobe et al. ..... 345/60

FOREIGN PATENT DOCUMENTS

| | | |
|---|---|---|
| EP | 0919984 A2 | 6/1999 |
| EP | 0947975 A1 | 10/1999 |
| EP | 1014330 A2 | 12/1999 |
| EP | 1136974 A1 | 9/2001 |
| WO | WO 00/46782 | 8/2000 |

* cited by examiner

*Primary Examiner*—Amare Mengistu
(74) *Attorney, Agent, or Firm*—Joseph S. Tripoli; Harvey D. Fried; Sammy S. Henig

(57) ABSTRACT

The present invention relates to a method for improving grey scale fidelity portrayal of pictures displayed on matrix display screens. The method comprises the following steps:

a) for a given peak white level, distributing the sustain pulses among the sub-fields, the number of pulses corresponding to the sub-field weighting, b) mapping the sub-field codes to luminance codes, c) re-ordering luminance codes in a definite order, d) mapping the video levels to the available luminance codes, e) processing the video levels to achieve intermediate levels of luminance f) then, mapping luminance codes to the output sub-field codes.

The method is used in plasma display panels (PDP).

13 Claims, 3 Drawing Sheets

METHOD AND APPARATUS FOR PROCESSING VIDEO PICTURES, ESPECIALLY FOR IMPROVING GREY SCALE FIDELITY PORTRAYAL

The present invention relates to a method for processing video pictures, especially to a method for improving grey scale fidelity portrayal of pictures displayed on matrix display screens like plasma display panels (PDPs) or other display devices based on the principle of duty cycle modulation (PWM for Pulse Width Modulation) of light emission. The invention also relates to an apparatus for carrying out the method.

BACKGROUND OF THE INVENTION

The invention will be described in relation with PDP but may be applicable to other types of display as mentioned above.

As well known, a plasma display panel is constituted by two insulating plates sealed together to form a space filled with gas. Ribs are provided inside the space to form a matrix array of discharge cells which could only be "ON" or "OFF". Also, unlike other displays such as CRT (Color ray tube) or LCD (Liquid Crystal Display) in which grey levels are expressed by analogue control of the light emission, a PDP controls the grey level by modulating the number of light pulses per frame. These light pulses are known as sustain pulses. The time-modulation will be integrated by the eye over a period corresponding to the eye time response.

In the field of video processing, an 8-bit representation of a luminance level is very common. In this case, each video level will be represented by a combination of the following 8-bits:

$$2^0=1,\ 2^1=2,\ 2^2=4,\ 2^3=8,\ 2^4=16,\ 2^5=32,\ 2^6=64,\ 2^7=128$$

To realize such a coding scheme with the PDP technology, the frame period which has a duration function of the frequency of 16 ms for 60 Hz or 20 ms for 50 Hz, is divided in 8 sub-periods known as sub-fields SF. Each sub-field SF corresponds to one of the 8 bits as shown in FIG. 1. The duration of the light emission for the bit $2^1=2$ is the double of that for the bit $2^0=1$, etc. . . . With a combination of these 8 sub-periods, it is possible to build 256 different grey levels. For example, the grey level 92 will thus have the corresponding digital code word 00111010=4+8+16+64. More specifically, in known plasma display technology, each sub-field SF is a period of time comprising:

- a writing/addressing period of fixed length in which the plasma cell is either brought to an excited state with a high voltage or to a neutral state with lower voltage,
- a sustain period depending on the sub-field weighting. A gas discharge is made with short voltage pulses or sustain pulses with equal amplitude and equal duration, the number of pulses corresponding to the sub-field weighting,
- an erasing period of fixed length in which the charge of the cells is quenched.

In addition, a priming pulse P may be used at the beginning of the frame period. Such priming makes a pre-excitation of the plasma cell to prepare the cells for homogeneous writing of each sub-field.

So video levels are mapped to a set of sub-field codes based on the sub-field weight. Thus, luminance is generated by means of a discrete number of sustain pulses distributed by a discrete number of sub-fields. If the number of sustain pulses which have to be distributed by the sub-fields of a frame corresponds to the number of video levels, the repartition would be straightforward as in the above example wherein 255 sustain pulses have to be distributed by a sub-field group 1-2-4-8-16-32-64-128 allowing 256 different luminance values. However, if for instance 293 sustain pulses have to be distributed, the process is substantially more complicated. Sustain pulses can not be neatly divided among the sub-fields giving rounding errors. Further complication arises due to the fact that the process of writing and erasing a sub-field also generates some luminance equally added to every bit sub-field regardless of its weight. So PDP panels are slightly non-linear, i.e. 100 sustain pulses will not produce 100 times more luminance than a single sustain pulse.

As similar to CRTs, PDPs require use of a Peak White Enhancement (PWE) circuit, which controls peak white level as a function of average image power. The number of peak white sustain pulses is adapted to said average picture power and the sustain pulses can not be neatly divided amongst the sub-fields as mentioned above.

Due to problems such as rounding errors, plasma non-linearities, existence of parasitic luminance components like addressing and erasing pulses, the known solution consisting to map the number of required sustain pulses to chosen sub-field code weight structure produces clearly perceptible grey scale portrayal non-linearities.

SUMMARY OF THE INVENTION

The gist of the present invention is to replace a given sub-field code based on sub-field weights by a metacode based on sub-field actual luminance.

The gist of the present invention is also to propose an apparatus for implementing the method which avoids large additional cost.

The present invention relates to a method for improving grey scale fidelity portrayal of pictures displayed on a display device wherein the grey level is obtained by modulating the number of light pulses per frame or sustain pulses, said method comprising the following steps:

a) for a given peak white level, distributing the sustain pulses among the sub-fields, the number of pulses corresponding to the sub-field weighting, b) mapping the sub-field codes to luminance codes, c) re-ordering luminance codes in a definite order, d) mapping the video levels to the available luminance codes, e) processing the video levels to achieve intermediate levels of luminance, f) then mapping luminance codes to the output sub-field codes.

Preferably, in step e, the video levels are processed to perform with a spatial and temporal change of the display value, a luminance linear interpolation between the available luminance levels. To do that, the video levels are dithered and truncated to integer precision. So the fractional part of luminance resolution lying between two consecutive luminance values may be rendered.

In addition, the steps mentioned above are iterated for all power level modes.

According to one embodiment, the mapping of sub-field codes to luminance codes is done by using a sub-field sustain luminance model. Such luminances model allows to evaluate the expected luminance brightness when the number of priming, sub-field writing and sustaining operations is known. It can also be done by using the luminance value of the sub-field. In this case, the luminance level for a given code is experimentally measured for a reference panel, i.e. a panel considered as typical for a given technology with centered physical parameters.

The re-ordering of the luminance code is done according to the ascending luminance values and if several codes produce approximately the same luminance codes, it is possible to drop some of them, the number of luminance codes being smaller than the number of original codes.

In step d, the mapping of the luminance codes is done with fractional precision, for example with 3 bits on the right side of the coma. This fractional precision corresponds to the part of luminance resolution beyond the discrete set of luminance levels of resolution that can be portrayed with a given plasma technology.

The present invention relates also to an apparatus for performing the above method. Said apparatus includes a picture average power measuring circuit, a control unit comprising a power level mode table and selecting the requested power level mode according to the average power value given by the average power measuring circuit, a meta-code sub-field coding unit for implementing at least the steps d and e. According to one embodiment, the meta-sub-field coding unit comprises two look-up-table blocks for implementing steps d and e. Between the two look-up-table blocks is provided a dithering adder and truncation block. Preferably, the look-up-table blocks are realised by an EEPROM memory that can be read bit sequentially by the control unit.

DRAWINGS

The present invention will be explained hereafter in more detail with reference to the following description and the drawings wherein.

DESCRIPTION OF PREFERRED EMBODIMENTS

Figure 1:
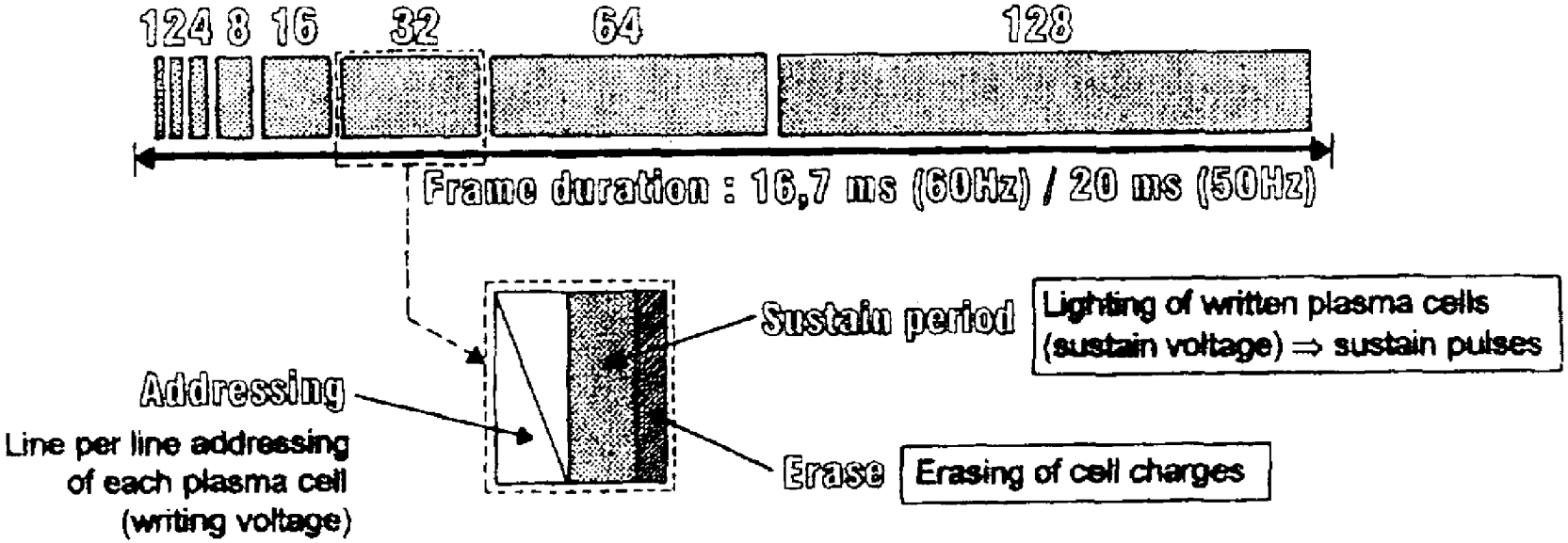
FIG. 1 shows an example of a sub-field organisation according to prior art.
Figure 2:
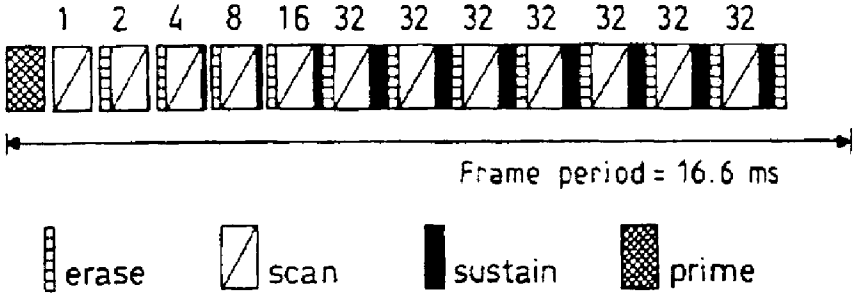
FIG. 2 shows an example of a sub-field organisation which may be used in the present invention.

The method of the present invention will be described with reference to a plasma display panel (PDP) where, as shown in FIG. 2, the frame period is subdivided in 12 sub-fields SF. Each sub-field SF has assigned a specific weight which determines how many light pulses are produced in this sub-field. Light generation is controlled by sub-field code words. A sub-field code word is a binary number which controls sub-field activation and inactivation. Each bit being set to 1 activates the corresponding sub-field SF. Each bit being set to 0 inactivates the corresponding sub-field SF. In an activated sub-field SF, the assigned number of light pulses or sustain pulses will be generated. In an inactivated sub-field, there will be no light generation. In the sub-field organisation shown in FIG. 2, the sub-field weights are the following:

1, 2, 4, 8, 16, 32, 32, 32, 32, 32, 32, 32.

As already explained above and shown in FIG. 2, each sub-field period comprises:

- an addressing/writing period referenced "scan". In this period of fixed length, the plasma cell is either brought to an excited cell or to a neutral cell,
- a sustain period referenced "sustain" in which a gas discharge is made with short voltage pulses which lead to corresponding short lighting pulses. Only the cells previously excited will produce lighting pulses. The number of pulses corresponds to the sub-field weighting,
- an erasing period, referenced "erase" in which the charge of the cells is quenched.

In addition, in FIG. 2, a priming pulse referenced "prime" is used at the beginning of the frame period. This priming pulse makes a pre-excitation of the plasma cells for a homogeneous writing.

So with the above sub-field organisation, the following sub-field code words will be obtained for the 256 grey levels if the following rules are applied, i.e. a digital code is used for the sub-fields 0 to 4 corresponding to 5LSB and sub-fields 5 to 11 are filled from left to right.

| Sub-field code | |
|---|---|
| level | SF code |
| 0 | 00000 000 0000 |
| 1 | 10000 000 0000 |
| 2 | 01000 000 0000 |
| 3 | 11000 000 0000 |
| . . . | |
| 30 | 01111 000 0000 |
| 31 | 11111 000 0000 |
| 32 | 00000 100 0000 |
| . . . | |
| 64 | 00000 110 0000 |
| 96 | 00000 111 0000 |
| 128 | 00000 111 1000 |
| . . . | |
| 255 | 11111 111 1111 |

According to the present invention, the building of meta-codes generated upon the output luminance levels, more particularly the mapping of sub-field weight codes to luminance codes requires either the use of a sub-field sustain luminance model or the determination of the real luminance value.

An example of a sustain luminance model will be given hereafter. This model can be more or less accurate. A valid first approximation model may be obtained by measuring some values and then, by determining the curve that best fits to the experimental points.

For the explanation of the present invention, a very simplified luminance model will be used:

Luminance Model 1 prime pulse=0.75 cd m-2

1 sustain pulse=1.00 cd m-2

1 write pulse=0.375 cd m-2

1 erase pulse=0.125 cd m-2

1 write-erase pulse=0.125+0.375=0.5 cd m2

In this simple model no phosphor saturation is considered. In actual panels, a sub-field with 100 sustains does not produce 100 times the luminance of a sub-field having a single sustain pulse.

The method of building meta-codes according to the present invention will be explained in the case of two different power levels, the first one corresponding to 255 sustain pulses and the second one to 382 sustain pulses amongst a range from about 120 sustain pulses up to 1200 sustain pulses. In addition, the generation of the first 20 video levels amongst 1024 (corresponding to 10 bits of input video resolution) will be described in the examples.

1—meta-code A: 255 sustain pulses according to the present invention, the step a consists in distributing the 255 sustain pulses among the 12 sub-fields. In this specific case, the mapping is straightforward.

Step a:

| Sub-field | Number of sustain pulses |
|---|---|
| SF0: | 1 sustain |
| SF1: | 2 sustains |
| SF2: | 4 sustains |
| SF3: | 8 sustains |
| SF4: | 16 sustains |
| SF5: | 32 sustains |
| SF6: | 32 sustains |
| SF7: | 32 sustains |
| SF8: | 32 sustains |
| SF9: | 32 sustains |
| SF10: | 32 sustains |
| SF11: | 32 sustains |

In step b, the sub-field codes are mapped to luminance levels using the luminance model described above. In this case, priming is not considered because its contribution is a merely constant offset for all codes which can not be compensated. Only, the first 6 sub-field codes need to be considered for the coding of the first 20 video levels.

Step b:

| | SF code | luminance levels |
|---|---|---|
| 0 | 0000 0000 0000 | 0*0.50 + 0*1.00 = 0.00 cd m-2 |
| 1 | 1000 0000 0000 | 1*0.50 + 1*1.00 = 1.50 cd m-2 |
| 2 | 0100 0000 0000 | 1*0.50 + 2*1.00 = 2.50 cd m-2 |
| 3 | 1100 0000 0000 | 2*0.50 + 3*1.00 = 4.00 cd m-2 |
| 4 | 0010 0000 0000 | 1*0.50 + 4*1.00 = 4.50 cd m-2 |
| 5 | 1010 0000 0000 | 2*0.50 + 5*1.00 = 6.00 cd m-2 |
| 6 | 0110 0000 0000 | 2*0.50 + 6*1.00 = 7.00 cd m-2 |

wherein 0.50 cd m-2 corresponds to 1 write-erase pulse and 1.00 cd m-2 to 1 sustain pulse.

The following step consists in re-ordering the luminance codes in order of ascending luminance. In addition, if two or more of the weight codes produce approximately the same luminance, it is possible to drop some of them leading to a number of luminance codes smaller than the number of the original codes.

Step c:

| SF code | luminance | luminance code |
|---|---|---|
| 0 | 0.00 cd m-2 | #0 |
| 1 | 1.50 cd m-2 | #1 |
| 2 | 2.50 cd m-2 | #2 |
| 3 | 4.00 cd m-2 | #3 |
| 4 | 4.50 cd m-2 | dropped |
| 5 | 6.00 cd m-2 | #4 |
| 6 | 7.00 cd m-2 | #5 |

Then the video levels are mapped to the luminance codes. In the specific example, wherein a 10-bit input video resolution is used, the maximum video level 1023 corresponding to a peak white video level is mapped to the maximal luminance level which is chosen to be of 255.75 cd m-2 instead of 261 cd m-2. The value 261 cd m-2 corresponds to the maximum value of luminance that is produced when all 12 sub-fields are on. The choice of 255.75 cd m-2 corresponds to 0.25 cd m-2 per video level. This simplifies calculations.

Step d:

| Video level | luminance level | luminance code |
|---|---|---|
| 0 | 0.00 cd m-2 | #0.000 |
| 1 | 0.25 cd m-2 | #0.125 |
| 2 | 0.50 od m-2 | #0.375 |
| 3 | 0.75 cd m-2 | #0.500 |
| 4 | 1.00 cd m-2 | #0.625 |
| 5 | 1.25 cd m-2 | #0.875 |
| 6 | 1.50 cd m-2 | #1.000 |
| 7 | 1.75 cd m-2 | #1.250 |
| 8 | 2.00 od m-2 | #1.500 |
| 9 | 2.25 cd m-2 | #1.750 |
| 10 | 2.50 cd m-2 | #2.000 |
| 11 | 2.75 cd m-2 | #2.125 |
| 12 | 3.00 cd m-2 | #2.375 |
| 13 | 3.25 cd m-2 | #2.500 |
| 14 | 3.50 cd m-2 | #2.625 |
| 15 | 3.75 cd m-2 | #2.875 |
| 16 | 4.00 cd m-2 | #3.000 |
| 17 | 4.25 cd m-2 | #3.125 |
| 18 | 4.50 cd m-2 | #3.250 |
| 19 | 4.75 cd m-2 | #3.375. |

In the above table, underscored video levels map without rounding to select luminance codes. The other values are built using luminance linear interpolation rounded to the nearest eighth between two consecutive luminance codes. The choice of 8 is for avoiding disturbing dithering noise. So the linear interpolation coefficients are always a multiple of 1/8. For example:

video level 1: (0.25 cd m-2)

7/8 of code #0+1/8 of code #1=7/8*0.00+1/8*1.50=0.18 cd m-2 video level 8: (2.00 cd m-2)

4/8 of code #1+4/8 of code #2=4/8*1.50+4/8*2.50=2.00 cd m-2.

At this step, video levels are dithered and truncated to integer precision. In this case, the mapping of step d is done by using a look up table of 1024 entries and 11 bits. The 11 bits available from the look up table correspond to 8 bits integer resolution and 3 bits fractional resolution. The 3 bits of fractional resolution are added with the 3 bits of dithering and then truncated. A dithering method is used at this level for reducing the perceptibility of quantisation noise. This noise is due to the fact that the displayed luminance is linear to the number of pulses but the eye response and its sensitivity to noise is not linear.

In darker areas, the eye is more sensitive than in brighter areas so the quantisation error will be quite noticeable in the darker areas. Furthermore, the required degamma function in PDP increases quantisation noise in video dark areas, resulting in a perceptible lack of resolution. Several dithering methods may be used in the frame of the present invention such as the 3D dithering method described in EP application 00 250 099.9 in the name of the applicant.

The last step of the method of the present invention consists in mapping the luminance codes to the output sub-field codes. This step used a second look up table of 256 entries*16 bits.

Step e:

| luminance code | SF code | SF mapping |
|---|---|---|
| #0 | 0 | 0000 0000 0000 |
| #1 | 1 | 1000 0000 0000 |
| #2 | 2 | 0100 0000 0000 |
| #3 | 3 | 1100 0000 0000 |
| #4 | 5 | 1010 0000 0000 |
| #5 | 6 | 0110 0000 0000 |

2—meta-code B: 382 sustain pulses

The method of the present invention following the same steps as above will be described in the case of a power level corresponding to 382 sustain pulses. This corresponds to adding 50% more sustain pulses to every sub-field, except the first sub-field, due to the impossibility of adding half a sustain pulse.

step a:

In this case, the repartition of 382 sustain pulses by the 12 sub-fields is the following:

| | |
|---|---|
| SF0: | 1 sustain |
| SF1: | 3 sustains |
| SF2: | 6 sustains |
| SF3: | 12 sustains |
| SF4: | 24 sustains |
| SF5: | 48 sustains |
| SF6: | 48 sustains |
| SF7: | 48 sustains |
| SF8: | 48 sustains |
| SF9: | 48 sustains |
| SF10: | 48 sustains |
| SF11: | 48 sustains |

step b:

As above, only the first 6 sub-field codes need to be considered.

| | SF code | luminance levels |
|---|---|---|
| 0 | 0000 0000 0000 | 0*0.50 + 0*1.00 = 0.00 cd m-2 |
| 1 | 1000 0000 0000 | 1*0.50 + 1*1.00 = 1.50 cd m-2 |
| 2 | 0100 0000 0000 | 1*0.50 + 3*1.00 = 3.50 cd m-2 |
| 3 | 1100 0000 0000 | 2*0.50 + 4*1.00 = 5.00 cd m-2 |
| 4 | 0010 0000 0000 | 1*0.50 + 6*1.00 = 6.50 cd m-2 |
| 5 | 1010 0000 0000 | 2*0.50 + 7*1.00 = 8.00 cd m-2 |
| 6 | 0110 0000 0000 | 2*0.50 + 9*1.00 = 10.00 cd m-2 |

step c:

The luminance codes are re-ordered as follows:

| SF code | luminance | luminance code |
|---|---|---|
| 0 | 0.00 cd m-2 | #0 |
| 1 | 1.50 cd m-2 | #1 |
| 2 | 3.50 cd m-2 | #2 |
| 3 | 5.00 cd m-2 | #3 |
| 4 | 6.50 cd m-2 | #4 |
| 5 | 8.00 cd m-2 | #5 |
| 6 | 10.00 cd m-2 | #6 |

In this case, no sub-field code has been dropped.

step d:

The peak-white video level 1023 is mapped to 383.625 cd m-2. This corresponds to 0.375 per level.

| video level | luminance level | luminance code |
|---|---|---|
| 0 | 0.000 cd m-2 | #0.000 |
| 1 | 0.375 cd m-2 | #0.250 |
| 2 | 0.750 cd m-2 | #0.500 |
| 3 | 1.125 cd m-2 | #0.750 |
| 4 | 1.500 cd m-2 | #1.000 |
| 5 | 1.875 cd m-2 | #1.250 |
| 6 | 2.250 cd m-2 | #1.375 |
| 7 | 2.625 cd m-2 | #1.500 |
| 8 | 3.000 cd m-2 | #1.750 |
| 9 | 3.375 cd m-2 | #2.000 |
| 10 | 3.750 cd m-2 | #2.250 |
| 11 | 4.125 cd m-2 | #2.500 |
| 12 | 4.500 cd m-2 | #2.750 |
| 13 | 4.875 cd m-2 | #3.000 |
| 14 | 5.250 cd m-2 | #3.250 |
| 15 | 5.625 cd m-2 | #3.500 |
| 16 | 6.000 cd m-2 | #3.750 |
| 17 | 6.375 cd m-2 | #4.000 |
| 18 | 6.750 cd m-2 | #4.250 |
| 19 | 7.125 cd m-2 | #4.500 |

The step concerning dithering of video level and truncation to integer precision is done as described above.

step e:

In this step, the luminance codes are mapped to output sub-field codes:

| luminance code | SF code | SF mapping |
|---|---|---|
| #0 | 0 | 0000 0000 0000 |
| #1 | 1 | 1000 0000 0000 |
| #2 | 2 | 0100 0000 0000 |
| #3 | 3 | 1100 0000 0000 |
| #4 | 4 | 0010 0000 0000 |
| #5 | 5 | 1010 0000 0000 |

A cost effective implementation of the above method will be described now with reference to FIGS. 3 to 5.

Figure 3:
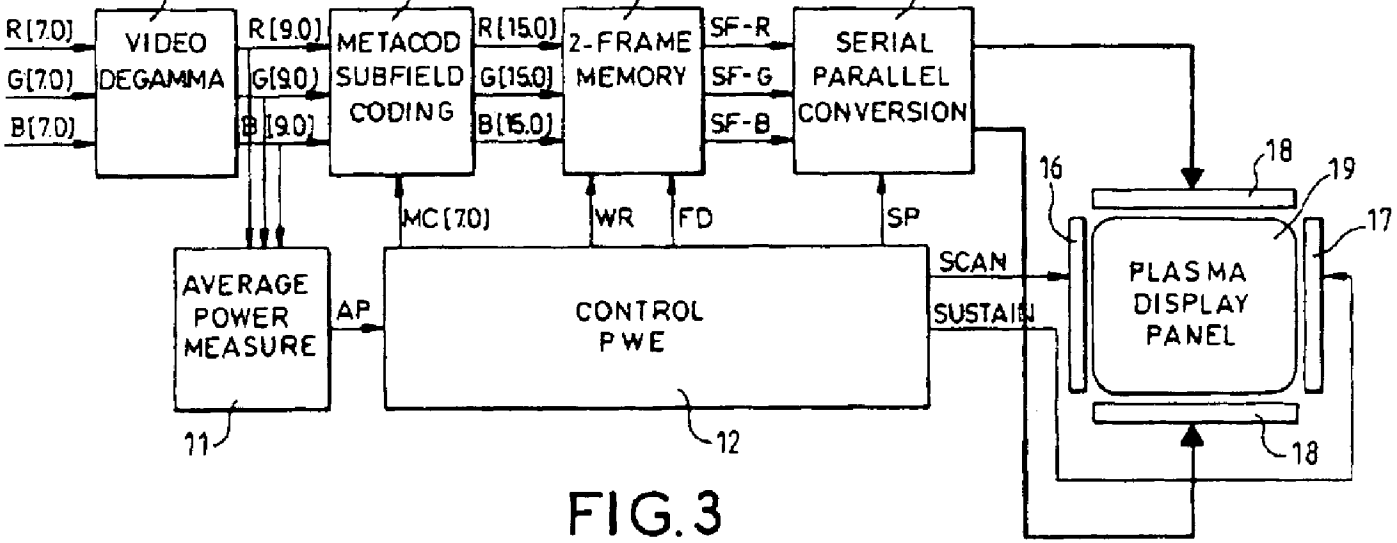
FIG. 3 shows schematically a block diagram of an apparatus implementing the present invention.

In FIG. 3, a block diagram of a possible circuit implementation for the above explained method is illustrated. Input R, G, B video data is forwarded to a video degamma unit 10. Output R, G, B video data is forwarded to an average power measure unit 11 and to a metacode sub-field coding unit 13. The average power measure unit may be of the type described in PCT patent application WO00/46782. The average power measure unit 11 calculates the average power value AP and forwards it to the peak white enhancements or PWE control block 12. As example, the average power value of a picture is calculated by simply summing up the pixel values for all R, G, B data streams and dividing the result through the number of pixel values multiplied by three. The control block 12 consults its internal power level mode table and directly generates the selected mode control signals for the other processing blocks. It selects the sustain table to be used and the sub-field meta-code to be used, i.e. the data MC [7,0] coded on 8-bits corresponding to the 256 metacodes necessary for a full range of power levels from about 120 sustain pulses up to 1200 sustain pulses.

The PWE control block 12 also controls the 2 Frame Memory circuit 14 and the Serial/Parallel conversion circuit 15. More specifically, it controls the writing of RGB pixel data in the first frame memory of the circuit 15 through the WR signal and the reading of RGB sub-field data from the second frame memory of the circuit 15 through the RD signal. The RGB sub-field data SF-R, SF-G, SF-B are forwarded from the 2 Frame Memory circuit 14 to the Serial/Parallel conversion circuit 15 controlled by the SP signal from the PWE control circuit 12. Finally, the PWE control circuit 12 generates the SCAN and SUSTAIN pulses required to control the PDP driver circuits 16,17.

In fact, two frame memories are required in the circuit 14. Data is written pixel-wise into one frame memory, but read sub-field-wise from the other frame memory. In order to read the complete first sub-field, a whole frame must already be present in the memory. In a practical implementation two whole frame memories are present, and while one frame memory is being written, the other is being read, avoiding in this way reading the wrong data. As later seen, in a cost optimized architecture, the two frame memories may be located on the same SDRAM memory IC, and access to the two frames is time multiplexed.

The described implementation introduces a delay of 1 frame between power measurement and sub-field coding. Power level is measured, and at the end of a given frame, the average power value becomes available to the controller 12. At that time, it is however too late to take an action, for instance like modifying the metacode selection LUTs, because data has already been written in the frame memory.

This problem is in reality not very serious, because, since data has to go through the frame memory, a delay of one frame also occurs on the signal processing path. This means that the number of generated sustain pulses by the PWE controller 12 will be correctly adapted to the picture contents. The only error that cannot be compensated is the use of the wrong metacode LUT when there is a mode switch, i.e. a modification of picture power contents. As described on PCT patent application WO00/46782, the number of mode switches will be limited, for instance by the addition of an hysterisis circuit that filters out picture power oscillations, and further more mode switches will be contiguous modes. The meta-codes for contiguous modes are similar because the number of sub-field sustains is similar and therefore most of the incurred errors will not be perceptible to the human viewer.

Figure 4:
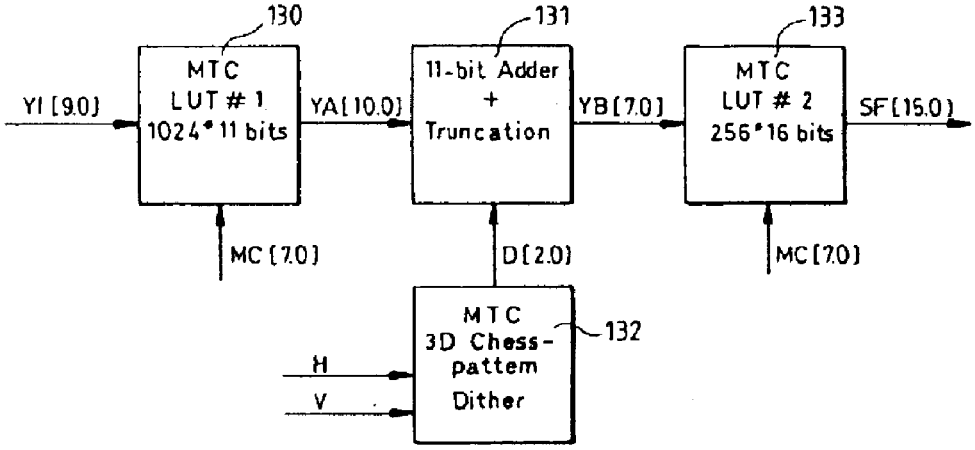
FIG. 4 shows a detailed block diagram of the meta-code sub-field coding unit used in the apparatus of the FIG. 3.

FIG. 4 shows one possible implementation of the meta-code sub-field coding unit 13. This unit comprises a first look up table 130 comprising 1024×11 bits for handling 10 bits of input video resolution as described in the above method. Each of the 3 color components is coded with the same look-up tables. The first look-up table 130 is used for the implementation of step d of the coding process. The look-up table 130 is controlled by the MC value from the PWE control unit 12. At the output of the look-up table, 11 bits video signal is obtained. The available 11-bits correspond to 8-bits integer resolution and 3-bits fractional resolution. Then, the 11-bits of video signal YA [10-0] are forwarded to a circuit 131. In this circuit 131, the 3-bits of fractional resolution are added with the 3-bits of dithering forwarded by the dithering circuit 132 and then truncated.

The dithering circuit 132 may be a 3D-chess-pattern dithering block as described in EP patent application 00 250 099.9. Other dithering patterns could also be used. The circuit 131 is used to implement step e in the above described method.

The video signal YB[7,0] from the circuit 131 is then forwarded to a second look-up table 133 comprising 256×16 bits. This look-up table 133 is used to implement step f in the above described method.

One problem of the above described implementation is the large size of the look-up tables which would be expensive to implement. In fact, for the implementation of a single metacode with the bit width as described on the above figure, 15360 bits of LUT would be required. If 256 discrete codes are implemented, 3.93 M bit of LUT data would be required.

So, a not too expensive implementation will be described with reference to FIG. 5.

Most of the blocks (video degamma, sub-field coding, serial parallel conversion controller) are moved to the plasma display controller 20, that is realized in the form of an ASIC. The look-up table data is stored on an external EPROM circuit 21 that can be read bit sequentially by the controller 20. In normal operation at the end of every frame, new LUT data has to be downloaded by the controller. During this time, the sub-field coding processed has to be stopped. Since access to the external EPROM is sequential, thus quite slow, some video lines might be lost which would be acceptable.

So, external SDRAM circuit 22 main function is to store the 2 frames of required video memory. Its capacity will usually be larger than the minimum required for storing those 2 frame memories. This is due to the fact that memory capacity corresponds always to a power of 2; i.e. 64 Mbit, 128 Mbit, 256 Mbit and so on. The redundant memory space is more than enough to store the complete meta-codes look-up tables.

Figure 5:
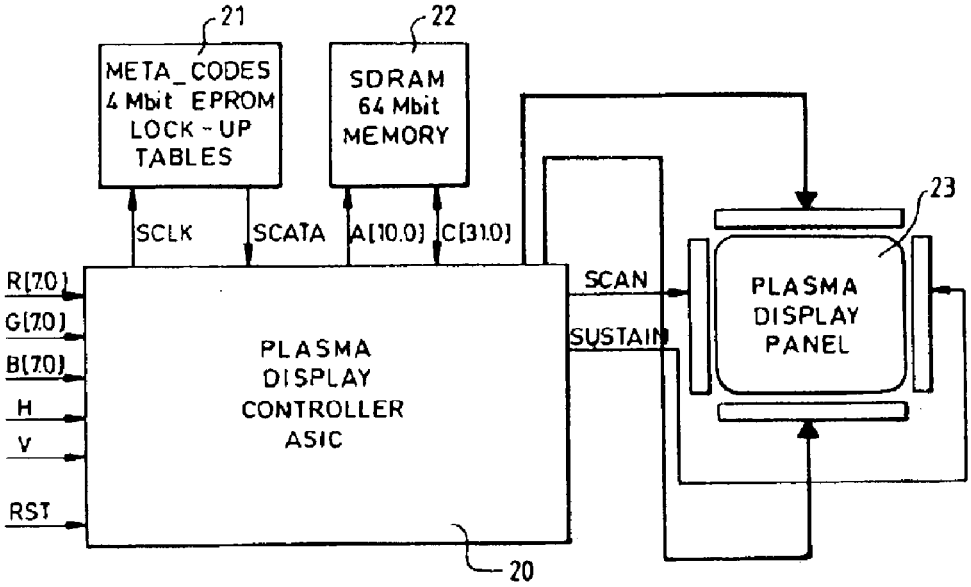
FIG. 5 shows the implementation of the apparatus of FIG. 3.

The main idea of the implementation of FIG. 5 is to transfer all the look-up tables data to the free SDRAM address space, during set power-up. During power-up, LUT data is sequentially read from the external EPROM using pins SCLK and SDATA. Afterwards, the plasma controller will, at the end of every frame during the vertical blanking, compute the picture power and the required meta-code for the following frame. Once the new code has been determined, the controller will request the required data from the SDRAM, and will load the required table data on the internal sub-field coding block. This access will be quite fast because no sub-field data has to be written or read in the SDRAM during vertical blanking, and SDRAM bandwith is huge.

The solution described above reduces in fact the costs of implementing meta-code to an added external 4 Mbit EPROM as well as a couple of additional pins on the SDRAM controller.

What is claimed:

1. A method for improving grey scale fidelity portrayal of pictures displayed as grey levels on a display device wherein the grey level is obtained by modulating the number of light pulses per frame called sustain pulses, said method comprising the following steps:

a) for a given peak white level, distributing the sustain pulses among the sub-fields, the number of pulses corresponding to the sub-field weighting, b) mapping the sub-field codes to luminance codes, c) re-ordering luminance codes in a definite order, d) mapping the video levels to the available luminance codes, e) processing the video levels to achieve intermediate levels of luminance f) then, mapping luminance codes to the output sub-field codes.

2. A method according to claim 1, wherein, in step e, the video levels are processed to perform with a spatial and temporal change of the display value, a luminance linear interpolation between the available luminance levels.

3. A method according to claim 2, wherein the luminance linear interpolation between the available luminance levels is done using the dithering and truncation to integer precision of the video levels.

4. A method according to claim 1, wherein the mapping of sub-field codes to luminance codes is done by using a sub-field sustain luminance model.

5. A method according to claim 1, wherein the mapping of sub-field codes to luminance codes is done by using the luminance value of the sub-field.

6. A method according to claim 1, wherein the re-ordering of the luminance code is done according to the ascending luminance values.

7. A method according to claim 6, wherein, if several codes produce approximately the same luminance codes, some codes are dropped.

8. A method according to claim 1, wherein, in step d, the mapping of the luminance codes is done with fractional precision.

9. A method according to claim 1, wherein the steps a to f are iterated for all power level modes.

10. An apparatus for performing the method according to claim 1, wherein said apparatus includes a picture average power measuring circuit calculating the average power value of the video data, a control unit comprising a power level mode table and selecting the requested power level mode according to the average power value given by the average power measuring circuit, and a meta-code sub-field coding unit for implementing at least the steps of mapping the video levels to the available luminance codes and processing the video levels to achieve intermediate levels of luminance; said meta-code sub-field coding unit being controlled by the control unit.

11. An apparatus according to claim 10, wherein the meta-sub-field coding unit comprises two look-up-table blocks.

12. An apparatus according to claim 11, wherein the look-up-table blocks are realised by an EEPROM memory that can be read bit sequentially by the control unit.

13. An apparatus according to claim 10, wherein the control unit controls a plasma display panel.

* * * * *